US007934613B2

(12) United States Patent
Sudo et al.

(10) Patent No.: US 7,934,613 B2
(45) Date of Patent: May 3, 2011

(54) CONTAINER UNITS FOR DRUGS, DRUG CONTAINERS, AND RUBBER CLOSURES

(75) Inventors: Masamichi Sudo, Tokyo (JP); Morihiro Sudo, Tokyo (JP)

(73) Assignee: Daikyo Seiko, Ltd., Tokyo (JP)

( * ) Notice: Subject to any disclaimer, the term of this patent is extended or adjusted under 35 U.S.C. 154(b) by 855 days.

(21) Appl. No.: 11/219,845

(22) Filed: Sep. 7, 2005

(65) Prior Publication Data

US 2006/0054586 A1 Mar. 16, 2006

(30) Foreign Application Priority Data

Sep. 14, 2004 (JP) ..... 2004-266537

(51) Int. Cl.
*B65D 39/00* (2006.01)
*B65D 41/20* (2006.01)

(52) U.S. Cl. ..... 215/45; 215/355; 215/247; 604/415; 220/801

(58) Field of Classification Search ..... 215/45, 215/247, 249, 355; 604/415; 220/801
See application file for complete search history.

(56) References Cited

U.S. PATENT DOCUMENTS 1,814,650 A * 7/1931 Waite ..... 215/227
2,190,054 A * 2/1940 Cutter et al. ..... 215/247
2,367,908 A * 1/1945 Wash et al. ..... 215/358
2,393,578 A 1/1946 Waite
2,551,937 A * 5/1951 Gallagher ..... 215/45
2,780,225 A * 2/1957 Barr et al. ..... 604/403
2,848,130 A * 8/1958 Jesnig ..... 215/45
2,914,207 A * 11/1959 Moore ..... 215/270
4,227,620 A * 10/1980 Conway ..... 215/355
4,230,231 A 10/1980 Burnett et al.
4,274,543 A * 6/1981 Braymer et al. ..... 215/6
5,038,958 A * 8/1991 Dreier ..... 220/366.1
5,088,995 A * 2/1992 Packard et al. ..... 604/415
5,152,416 A * 10/1992 Cassel ..... 220/288
5,678,713 A * 10/1997 Derksen ..... 215/249
6,022,441 A 2/2000 Kawano (Continued)

FOREIGN PATENT DOCUMENTS

EP 1 170 219 A1 1/2002

(Continued)

*Primary Examiner* — Anthony Stashick
*Assistant Examiner* — James N Smalley
(74) *Attorney, Agent, or Firm* — Kenealy Vaidya LLP

(57) ABSTRACT

A container unit for a drug is composed of a container, which is formed of a cylindrical drug-solution-containing portion and a drug-solution-filling neck portion, and a rubber closure for sealing the drug-solution-filling neck portion. The rubber closure comprises a disk-shaped head portion and a substantially cylindrical leg portion arranged on a lower wall of the head portion. The container is provided with a flat surface formed on a side of its inner wall at a boundary between the drug-solution-containing portion and the drug-solution-filling neck portion such that a lower end wall of the leg portion of the rubber closure can be brought into close contact with the flat surface, and at least a side wall of the drug-solution-containing portion forms a cornerless, rounded surface on a side where a drug solution is to be contained. When the drug-solution-filling neck portion has been sealed with the rubber closure, the lower end wall of the leg portion and the flat surface of the container are maintained in close contact with each other without any protrusion of an inner circumferential edge of the lower end wall into an interior of the container beyond an inner circumferential edge of the flat surface.

12 Claims, 9 Drawing Sheets

U.S. PATENT DOCUMENTS

| | | | | |
|---|---|---|---|---|
| 6,146,364 | A | 11/2000 | Kawano | |
| 6,286,699 | B1 | 9/2001 | Sudo | |
| 6,635,043 | B2 * | 10/2003 | Daubert et al. | 604/411 |
| 6,715,624 | B2 * | 4/2004 | Brockwell | 215/247 |
| 2002/0003122 | A1 | 1/2002 | Sudo | |
| 2006/0091098 | A1 | 5/2006 | Thilly et al. | |

FOREIGN PATENT DOCUMENTS

| | | |
|---|---|---|
| FR | 1 096 330 | 6/1955 |
| GB | 342332 | 1/1931 |
| JP | 5520200 | 2/1980 |
| JP | 7-124257 | 5/1995 |
| JP | 7-213611 | 8/1995 |
| JP | 8-275984 | 10/1996 |
| JP | 10-179688 | 7/1998 |
| JP | 11-35062 | 2/1999 |
| JP | 11104234 | 4/1999 |
| JP | 2002-17816 | 1/2002 |
| JP | 2003-190285 | 7/2003 |
| WO | WO2004/018317 | 3/2004 |

* cited by examiner

Fig.1A − 1
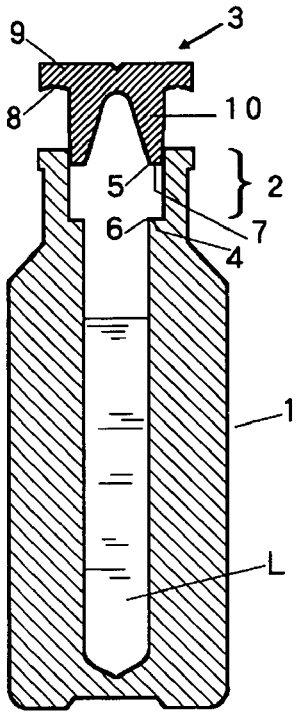
Fig.1A − 2
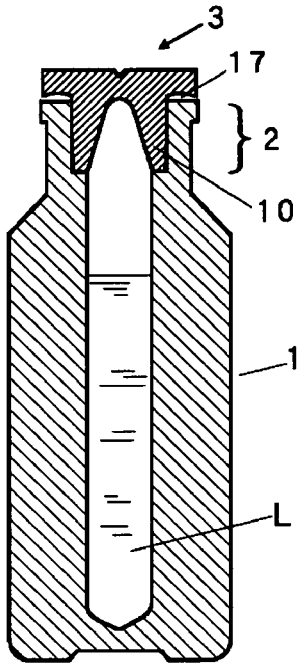
Fig.1A − 3
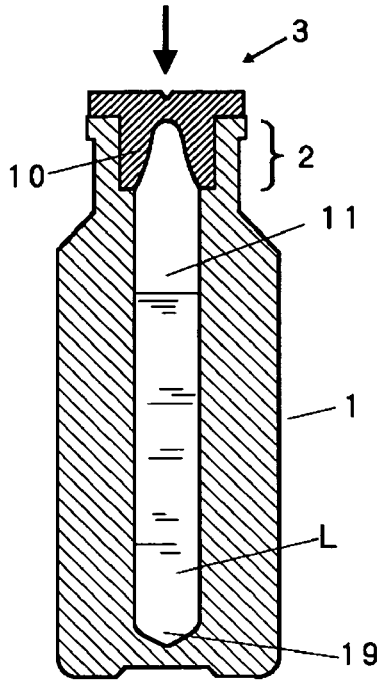

Fig.3A − 1
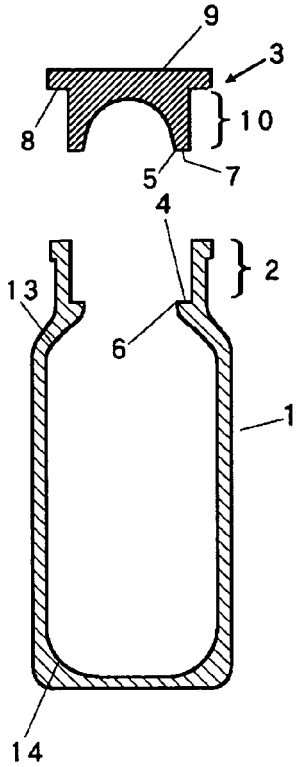
Fig.3A − 2
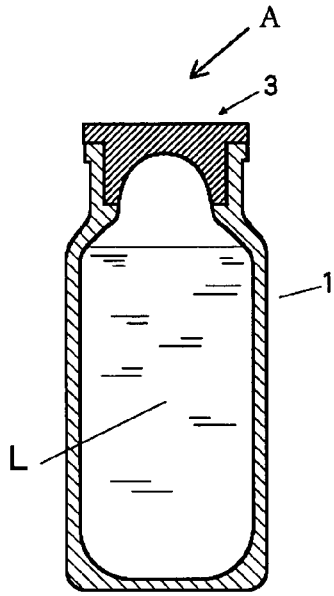
Fig.3A − 3
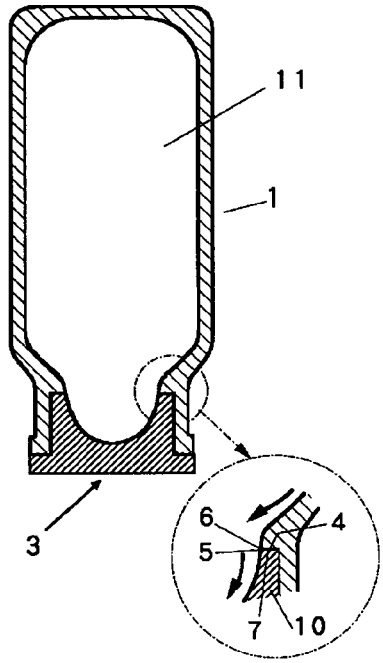

Fig.7A − 1
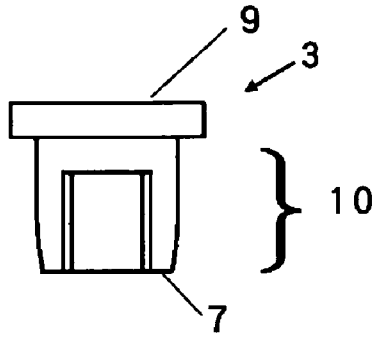
Fig.7A − 2
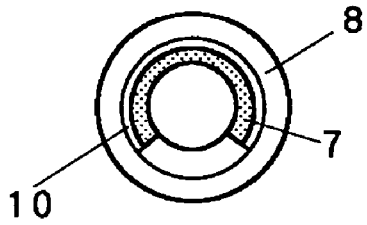
Fig.7B − 1
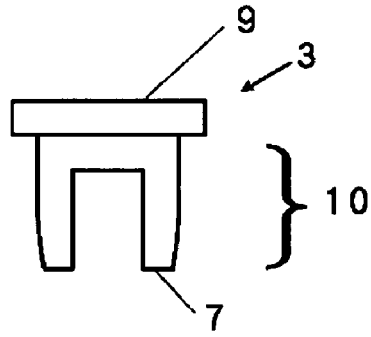
Fig.7B − 2
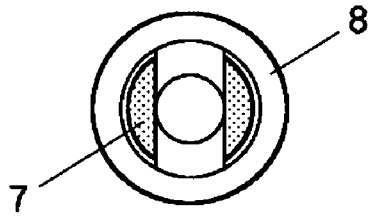

CONTAINER UNITS FOR DRUGS, DRUG CONTAINERS, AND RUBBER CLOSURES

FIELD OF THE INVENTION

This invention relates to container units for drugs, each of which is composed in combination of a container and a rubber closure having a leg portion and adapted to seal the container, drug containers, and rubber closures. Specifically, the present invention is concerned with container units for drugs, each of which makes it possible to minimize as much as possible a drug which is to remain in the container after use, and also with drug containers and rubber closures usable in the units.

DESCRIPTION OF THE BACKGROUND

Conventionally, a drug for injection (injection or drug solution) is supplied in a container with its mouth portion sealed with a rubber closure, and upon administration, a hypodermic needle is inserted through the rubber closure to collect the drug solution into a syringe from the container. Containers of the above-described type are called "vials" and are used widely. Rubber closures for use in such vials include those provided with a substantially cylindrical leg portion arranged on a lower wall of a head portion and those not provided with such a leg portion. In the case of a rubber closure provided with no leg portion, it cannot seal a container by itself because it is in the form of a thin flat disc. The sealing of the container is, therefore, effected by assembling the rubber closure in a protector and capping the container with the protector (see, for example, JP-A-11-035062).

With a rubber closure provided with a leg portion, on the other hand, sealing is generally achieved by inserting the leg portion into a mouth of a container, said mouth being a drug-solution-filling neck portion, and then wrapping up a circumferential side wall portion of the rubber closure and a flange portion of the container with an aluminum or plastics cap. FIG. 8A illustrates a container (vial) with a drug solution contained in a state sealed by a conventionally-known rubber closure having a leg portion and inserted in a mouth portion, i.e., a drug-solution-filling neck portion of the container. FIG. 8A shows a drug-solution-containing portion 1, the drug-solution-filling neck portion 2, and the drug solution L such as an injection contained in the drug-solution-containing portion. Designated at numeral 3 is the rubber closure for sealing the drug-solution-filling neck portion 2. By inserting a leg portion of the rubber closure 3 into the mouth portion 2 of the container, the drug-solution-filling neck portion 2 is sealed up. Therefore, the rubber closure generally has a substantially cylindrical shape so that, as illustrated in FIG. 8A, its outer circumferential wall can be brought into close contact with the inner circumferential wall of the drug-solution-filling neck portion 2 of the container (see, for example, JP-A-08-275984, JP-A-2002-017816, and JP-A-10-179688).

An inner wall of the drug-solution-filling neck portion 2 of the conventional container (vial) is, however, not provided with any concave or convex portion. In the state that the container is capped with the rubber closure, a lower end wall 7 of the leg portion 10 of the rubber closure is, therefore, exposed to the interior space of the drug-solution-containing portion 1 as shown in FIG. 8A. According to an investigation conducted by the present inventors, a drug solution 18 may remain on or in the vicinity of the lower end wall 7 of the leg portion 10 of the rubber closure as depicted in FIG. 8B when the container with the drug solution contained in a state sealed with the rubber closure 3 having the leg portion is turned upside down and the drug solution is collected by a syringe through the rubber closure 3 positioned on the lower side. JP-A-2002-017816 cited above proposes a container constructed such that an interior space in a bottom part of the container takes the form of a circular cone to permit withdrawing a drug solution by a syringe from the container without tilting the container. According to an investigation conducted by the present inventors, however, the drug solution 18 may also remain on or in the vicinity of the lower end wall 7 of the leg portion 10 of the rubber closure depending on the kind of the drug solution. There is, accordingly, a room for improvements.

A drug solution for injection, because of its property, effect or function, must be properly collected from a container and must be administered at an accurate dose. Nonetheless, the drug-solution-containing portion of a vial tends to have a smaller capacity in recent years, so that the remaining of the drug solution in the container after its collection by a syringe causes a greater problem than the case of a vial having a drug-solution-containing portion of large capacity. As a measure for such a problem, it may be contemplated to fill a drug solution while taking into consideration an amount in which the drug solution is to remain in the container. This method, however, accepts the wasting of the drug solution as a premise, and is not preferred from the standpoint of effective utilization of a resource and further, from the standpoint of disposal or the like of a waste material. On the other hand, drug solutions include expensive ones. In recent years, very expensive drug solutions as costly as from several thousands yen to several tens of thousands yen have been put on the market. It is, therefore, not only a matter of wasting but also forcing a patient to bear a high expense that such a costly drug solution remains in a container and is discarded.

SUMMARY OF THE INVENTION

Objects of the present invention are, therefore, to provide a vial-type container unit for a drug, a drug container and a rubber closure, each of which has an excellent shape such that, when a drug solution contained in the container is collected by a syringe, the amount of the drug solution that remains in the container can be significantly reduced without impairment of its sealing performance.

The above-described objects can be achieved by the present invention to be described hereinafter. According to an aspect of the present invention, there is thus provided a container unit for a drug. The container unit is composed in combination of a container, which is formed of a cylindrical drug-solution-containing portion and a drug-solution-filling neck portion, and a rubber closure for sealing the drug-solution-filling neck portion. The rubber closure comprises a disk-shaped head portion and a substantially cylindrical leg portion arranged on a lower wall of the head portion. The container is provided with a flat surface formed on a side of an inner wall thereof at a boundary between the drug-solution-containing portion and the drug-solution-filling neck portion such that a lower end wall of the leg portion of the rubber closure can be brought into close contact with the flat surface, and at least a side wall of the drug-solution-containing portion forms a cornerless, rounded surface on a side where a drug solution is to be contained. When the drug-solution-filling neck portion has been sealed with the rubber closure, the lower end wall of the leg portion and the flat surface of the container are maintained in close contact with each other without any protrusion of an inner circumferential edge of the lower end wall into an interior of the container beyond an inner circumferential edge of the flat surface.

In another aspect of the present invention, there is also provided a drug container capable of defining a sealed space therein to contain a drug solution upon closure of a mouth portion thereof with a rubber closure having a disc-shaped head portion and a substantially cylindrical leg portion arranged on a lower wall of the head portion. The container comprises a cylindrical, drug-solution-containing portion, a drug-solution-filling neck portion, and a flat surface formed on a side of an inner wall of the container at a boundary between the drug-solution-containing portion and the drug-solution-filling neck portion such that a lower end wall of the leg portion of the rubber closure can be brought into close contact with the flat surface, and at least a side wall of the drug-solution-containing portion forms a cornerless, rounded surface on a side where a drug solution is to be contained.

In a further aspect of the present invention, there is also provided a rubber closure for use with a drug container. The rubber closure comprises a disc-shaped head portion and a substantially cylindrical leg portion arranged on a lower wall of the head portion. The leg portion becomes gradually greater in thickness from the lower end wall toward a lower wall of the head portion. A space defined by an inner wall of the cylindrical leg portion has a shape of a circular cone with a rounded apex portion.

According to the present invention, the excellent vial-type container unit for a drug and the drug container and rubber closure usable in the container unit are provided. When the mouth portion of the drug-solution-filling neck portion of the container is sealed with the rubber closure having the leg portion to define a sealed space with a drug solution contained therein, high sealing performance is exhibited. When a hypodermic needle is pierced through the rubber closure and the drug solution is collected, the amount of the drug solution that remains in the container can be significantly reduced. According to the present invention that can bring about such excellent advantageous effects, the amount of the drug solution that remains in the container after use can be significantly reduced. As a consequence, the present invention can contributes to the effective utilization of resources, the efficient disposal of waste materials, and also reductions in the economic burdens to patients.

BRIEF DESCRIPTION OF THE DRAWINGS

FIGS. 1A-1 through 1A-3 are schematic cross-sectional views illustrating one example of the container unit for a drug according to the present invention.

FIGS. 3A-1 through 3A-3, FIG. 3B and FIG. 3C are schematic cross-sectional views of other examples of the container unit for a drug according to the present invention, respectively.

FIGS. 6A-1 and 6A-2 and FIGS. 6B-1 and 6B-2 are schematic illustrations showing the structures of rubber closures usable in the container unit for a drug according to the present invention, respectively.

FIGS. 7A-1 and 7A-2 and FIGS. 7B-1 and 7B-2 are schematic illustrations showing the structures of other rubber closures usable in the container unit for a drug according to the present invention, respectively.

DETAILED DESCRIPTION OF THE PREFERRED EMBODIMENTS

Figure 2A:
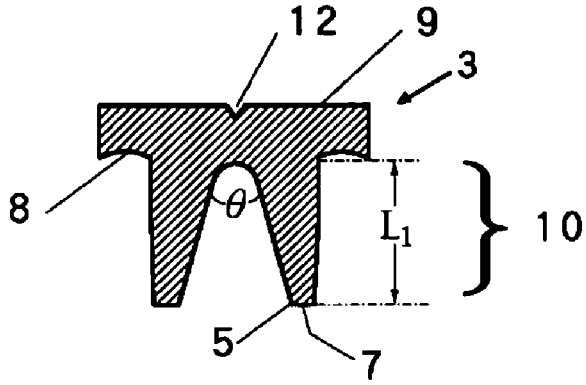
FIGS. 2A and 2B and FIG. 2C are schematic illustrations showing a rubber closure and container used in the container unit for a drug illustrated in FIGS. 1A-1 through 1A-3, respectively.

With reference to the accompanying drawings, the present invention will hereinafter be described in detail based on the preferred embodiments. One example of the container unit for a drug, which characterizes the present invention and may also be referred to as "the drug container unit" hereinafter, is shown in FIGS. 1A-1 through 1A-3. This container unit is suited especially as a sealable container for containing a small amount of a drug solution. As illustrated in the figures, this unit can define a sealed space 11, which has high sealing performance and is adapted to contain the drug solution, when a drug-solution-filling neck portion 2 (may hereinafter be called simply "the mouth portion 2") of a container is capped with a rubber closure 3 having a leg portion 10. A first characteristic feature of the container which constitutes the unit is that as illustrated in FIG. 1A-3, a flat surface 4 is formed on an inner wall of the container at a boundary between a drug-solution-containing portion 1, in which a drug solution L is contained with the rubber closure 3 inserted in the mouth portion 2 of the container to cap the container, and the mouth portion 2 to bring the a lower end wall 7 of the leg portion 10 of the rubber closure 3 into contact with the flat surface 4 and that at least a side wall of the drug-solution-containing portion 1 forms a cornerless, rounded surface on the side where the drug solution is to be contained.

A second characteristic feature of the drug container which characterizes the present invention is that, when the mouth portion 2 of the container has been sealed with the rubber closure 3, the lower end wall 7 of the leg portion 10 of the rubber closure and the flat surface 4 arranged in the container are maintained on close contact with each other without any protrusion of an inner circumferential edge 5 of the lower end wall 7 into an interior of said container beyond an inner circumferential edge 6 of the flat surface 4. Although details about this characteristic feature will be described subsequently herein, the possession of both the first and second characteristic features makes it possible to form a sealed space of high sealing performance for containing a drug solution, and moreover, to significantly reduce the amount of the drug solution that remains in the container after the drug solution is collected by a syringe through the rubber closure.

Figure 2B:
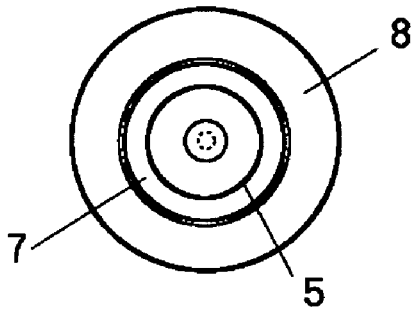
Figure 2C:
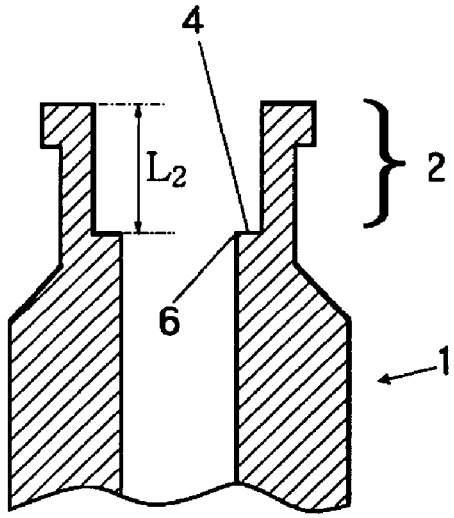

With reference to FIGS. 2A through 2C, a description will firstly be made about the rubber closure 3 which constitutes the drug container unit according to the present invention as illustrated in FIGS. 1A-1 through 1A-3. The rubber closure 3 shown in FIGS. 2A and 2B has been developed for the present invention. The rubber closure 3 for use in the present invention can be of any construction insofar as it is basically composed of a disc-shaped head portion 9 and a substantially cylindrical leg portion 10 arranged on a lower wall 8 of the head portion 9. It is, therefore, possible to use, for example, conventional rubber closures having leg portions as illustrated in FIGS. 6A-1 and 6A-2 and FIGS. 6B-1 and 6B-2. Different from these conventional rubber closures, the rubber closure which constitutes the drug container unit shown by way of example in FIGS. 1A-1 through 1A-3 has the leg portion which, as illustrated in FIGS. 2A and 2B, becomes gradually greater in thickness from the lower end wall 7 toward the lower wall 8 of the head portion 9, and a space defined by an inner wall of the cylindrical leg portion 10 is constructed to form a circular cone with a rounded apex portion. When the leg portion 10 of the rubber closure is formed in such a construction as described above, the drug solution is allowed to smoothly gather at a single point when, from the container the mouth portion of which is sealed with the rubber closure 3, the drug solution is collected by piercing a needle through the rubber closure 3 while holding the container in an inverted position (not shown). It is, therefore, possible to further reduce the amount of the drug solution that remains in the container after the collection.

As a preferred embodiment of the container to be combined with the rubber closure 3 of the above-described shape, it is possible to mention a container the internal shape of which is constructed such that, as illustrated in FIGS. 1A-1 through 1A-3, the space of the cylindrical drug-solution-containing portion 1 is constructed in the form of an elongated cylinder and a space 19 formed on the side of a lower part of the cylindrical drug-solution-containing portion 1 is constructed in the form of a circular cone. When constructed as described above, the sealed space 11 which is defined by the inner wall of the rubber closure 3 and the inner wall of the drug-solution-containing portion 1 to contain the drug solution takes the form of a cylinder the upper and lower end portions of which are circular cones as illustrated in FIG. 1A-3. By reducing the diameter of the cylindrical part of the drug-solution-containing portion 1 and shortening the length of the cylindrical part, it is possible to realize a drug container unit equipped with higher sealing performance and allowing to significantly reduce the remaining of the drug solution after the collection of the drug solution. As described above, the drug container unit of the construction shown in FIG. 1A-3 is constructed such that the upper and lower end portions of the sealed space 11 take the form of circular cones. When collecting by a syringe the drug solution L from the sealed space 11 in which the drug solution is contained, the drug solution can be collected without allowing it to remain in the sealed space 11 by piercing the needle through the rubber closure 3 while holding the rubber closure 3 up as illustrated in FIG. 1A-3. As mentioned above, however, the drug solution may remain in the sealed space 11 depending on the kind of the drug solution. Even in such a case, the amount of the drug solution that remains in the sealed space 11 after collection can be significantly reduced when the drug solution is collected by piercing the needle through the rubber closure 3 while holding the container upside down (not illustrated).

A description will next be made about other preferred embodiments of the drug container unit according to the present invention. In relation to the shape of the mouth portion 2 of the container in which the rubber closure 3 shown in FIGS. 1A-1 through 1A-3 is fitted, the rubber closure 3 is constructed as will be described hereinafter. As shown in FIG. 2A, the rubber closure 3 is designed such that the length $L_1$ of the leg portion 10 of the rubber closure 3 becomes slightly longer than the length $L_2$ from a wall (flange wall), in which the mouth portion 2 of the container opens, to the flat surface 4 arranged at the boundary between the mouth portion 2 and the drug-solution-containing portion 1. When the leg portion 10 of the rubber closure 3, said leg portion being of such construction as described above, is inserted into the mouth portion 2 of the container, a clearance 17 is formed between the flange wall of the container and the lower wall 8 of the head portion 9 of the rubber closure. This clearance 17 is eliminated as a result of compression of the rubber closure 3 when the rubber closure 3 and the flange portion of the mouth portion 2 of the container are wrapped up with an aluminum-made or resin-made cap (not shown) upon or after capping the container with the rubber closure (see FIG. 1A-3) As a result, the lower wall 8 of the head portion 9 of the rubber closure 3 is brought into contact under sufficient pressure with the flange wall of the mouth portion 2 of the container, and further, the lower end wall 7 of the leg portion 10 is brought into contact under sufficient pressure with the flat surface 4 arranged on the inner wall of the container at the boundary between the mouth portion 2 and the drug-solution-containing portion 1. It is, therefore, possible to provide the drug container unit with further improved sealing performance.

Figure 3B:
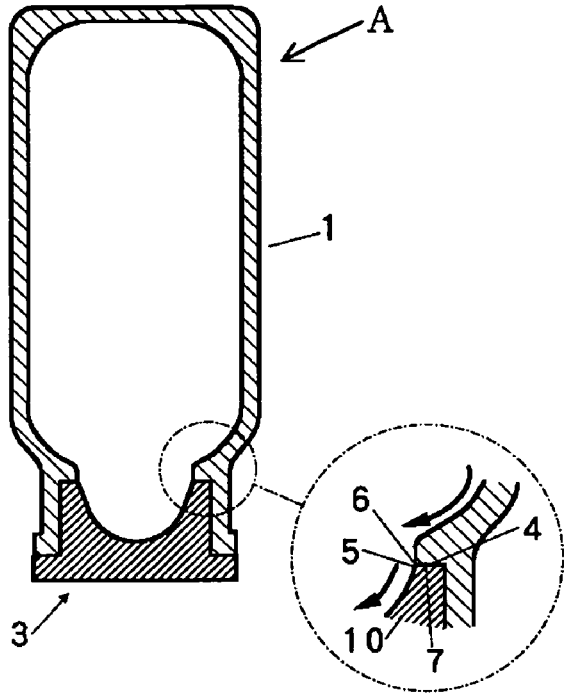
Figure 3C:
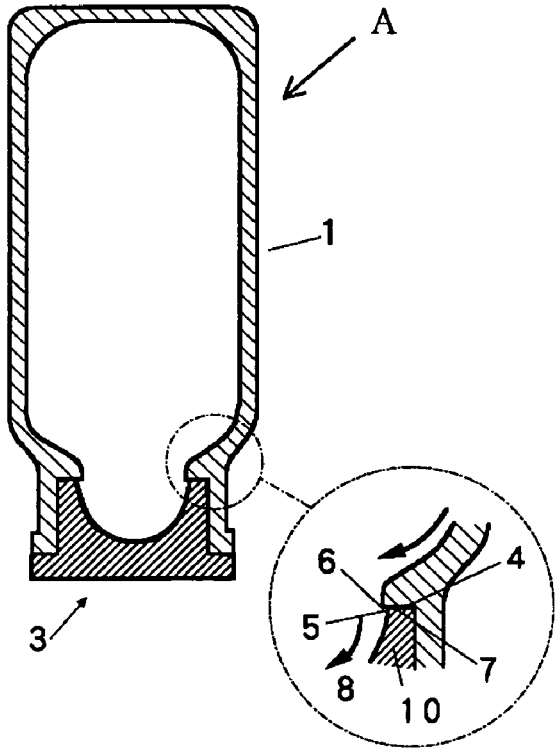

With reference to FIGS. 3A-1 through 3A-3, FIG. 3B and FIG. 3C, a detailed description will next be made about the flat surface 4, which characterizes the present invention and is arranged on the inner wall of the container at the boundary between the mouth portion 2 and the drug-solution-containing portion 1 (hereinafter simply called "the flat surface 4"). The flat surface 4 is characterized in its arrangement such that, when the drug-solution-filling neck portion 2 has been sealed with the rubber closure 3, the lower end wall 7 and the flat surface 4 are maintained in close contact with each other without any protrusion of an inner circumferential edge 5 of the lower end wall 7 toward the interior of the container beyond an inner circumferential edge 6 of said flat surface 4. As mentioned above, the principal object of the present invention is to provide a container unit for a drug, which can significantly reduce the amount of a drug solution that remains in the container after the drug solution contained in the container is collected with a syringe by piercing its needle through the rubber closure 3. In the course of an investigation toward such an object, the present inventors found that, upon collecting a drug solution with a syringe from a container by piercing its needle through a rubber closure, the drug solution is collected while holding the container upside down in many instances as illustrated in FIG. 3A-3 and most of the drug solution remaining in the container after the collection exists on the lower end wall 7 of the leg portion 10 of the rubber plug 3, said lower end wall 7 being exposed and directed upward in the container (see FIG. 8B). Based on the finding, the present inventors have proceeded with an extensive investigation about a combination of a container and a rubber closure, which makes it possible to reduce the amount of a drug solution that remains in the container after the collection of the drug solution. As a result, it has been found effective to arrange the flat surface 4, which satisfies the above-mentioned conditions to bring the lower end wall 7 of the leg portion of the rubber closure 3 into close contact, on the inner wall of the container at the boundary between the mouth portion 2 and the drug-solution-containing portion 1, leading to the present invention.

Described specifically, the flat surface 4 which is arranged on the inner wall of the container is constructed such that, when the mouth portion 2 has been sealed with the rubber closure 3, the lower end wall 7 and the flat surface 4 are maintained in close contact with each other without any protrusion of the inner circumferential edge 5 of the lower end wall 7 toward the interior of the container beyond the inner circumferential edge 6 of said flat surface 4 and at least the side wall of the drug-solution-containing portion 1 forms a cornerless, rounded surface. As a consequence, the drug solution L in the container is allowed to smoothly flow along the inner wall of the container without remaining in the container upon its collection by a syringe. In a state of use with the container held upside down, for example, as shown in an enlarged fragmentary view of a part encircled by a broken line in FIG. 3A-3, the lower end wall 7 of the leg portion 10 of the rubber closure 3 is not exposed and directed upward in the container but is maintained in close contact with the flat surface 4 over the entire areas thereof and the inner circumferential edge 5 of the lower end wall 7 of the leg portion 10 does not protrude toward the interior of the drug-solution-containing portion 1 beyond the inner circumferential edge 6 of the flat surface 4. The flat surface and the lower end wall 7 of the leg portion 10, therefore, are integrated with each other to form a smooth inner wall in the container. As indicated by arrows, the drug solution L in the container is, therefore, allowed to flow toward the side of the mouth portion 2 of the container along the inner circumferential edge 6 of the flat surface 4 of the container and the inner wall of the leg portion 10 without remaining inside the container.

In the present invention, the shape of the flat surface 4 arranged in the container is not limited to the above-described example insofar as the inner circumferential edge 5 of the lower end wall 6 of the leg portion 10 of the rubber closure does not protrude toward the interior of the drug-solution-containing portion 1 beyond the inner circumferential edge 6 of the flat surface 4. As illustrated in FIG. 3B, for example, a portion of the leg portion 10 of the rubber closure, said portion being located above and in the close vicinity of the inner circumferential edge 5 of the lower end wall 7, may protrude toward the interior of the drug-solution-containing portion 1 provided that with the lower end wall 7 of the leg portion 10 being in close contact with the flat surface 4, the inner circumferential edge 5 of the lower end wall 7 of the leg portion 10 does not protrude toward the interior of the drug-solution-containing portion 1 beyond the inner circumferential edge 6 of the flat surface 4. In this example, the flat surface 4 and the lower end wall 7 of the leg portion 10 also integrally forms the smooth inner wall of the container, and as indicated by arrows in the enlarged fragmentary view of the part encircled by a broken line in FIG. 3B, the drug solution L in the container is also allowed to flow toward the mouth portion 2 of the container along the inner circumferential edge 6 of the flat surface 4 of the container and the inner wall of the leg portion 10 without remaining in the container.

Further, as the example shown in FIG. 3C, the drug container unit may also have such a construction that with the lower end wall 7 of the leg portion 10 of the rubber closure being in close contact with the flat surface 4 arranged in the container, the inner circumferential edge 5 of the lower end wall 7 is located on an inner side than the inner circumferential edge 6 of the flat surface 4 provided that the inner circumferential edge 5 of the lower end wall 7 of the leg portion 10 does not protrude toward the interior of the drug-solution-containing portion 1 beyond the inner circumferential edge 6 of the flat surface 4. In this case, the inner circumferential edge 6 of the flat surface 4 of the container protrudes beyond the inner circumferential edge 5 of the lower end wall 7 of the leg portion 10 of the rubber closure. In this example, the drug solution L in the container is also allowed, as in the above-described example, to flow toward the mouth 2 of the container along the inner circumferential edge 6 of the flat surface 4 of the container and the inner wall of the leg portion 10 without remaining in the container as indicated by arrows in the enlarged fragmentary view of the part encircled by a broken line in FIG. 3C, and therefore, the objects of the present invention can be achieved.

Preferred embodiments of the container and rubber closure which constitutes the drug container unit according to the present invention can include those of the construction that, when the mouth portion 2 of the container has been capped and sealed, all walls that form the resulting sealed space 11 adapted to contain the drug solution form cornerless, rounded surfaces. Specific examples can include, for example, those of the shapes shown in FIGS. 3A-1 through 3A-3, FIG. 3B and FIG. 3C, respectively, and those of the shapes depicted in FIG. 4A and FIG. 4B, respectively. Described specifically, it is preferred, as illustrated in FIGS. 3A-1 through 3A-3, FIG. 3B and FIG. 3C, to form each of a bottom corner portion 14 of the drug-solution-containing portion 1, a portion 13 located as a shoulder of the container in the vicinity of the boundary between the drug-solution-containing portion 1 and the mouth portion 2 and a portion located in the vicinity of the inner circumferential edge 6 of the flat surface 4 into a smooth, rounded corner, to say nothing of forming the inner walls of the drug-solution-containing portion 1 and mouth portion 2 into cornerless, rounded surfaces, respectively.

Figure 4A:
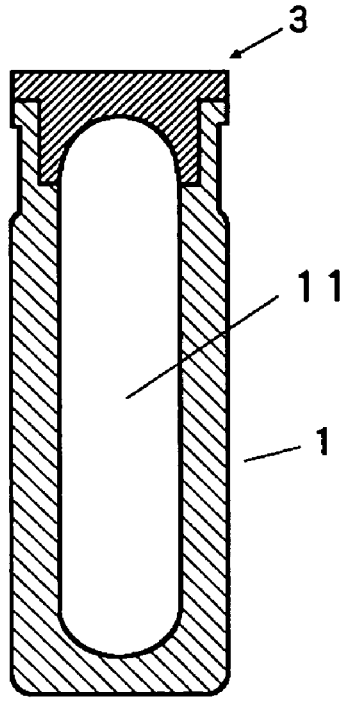
FIG. 4A and FIG. 4B are schematic cross-sectional views of other examples of the container unit for a drug according to the present invention, respectively.
Figure 4B:
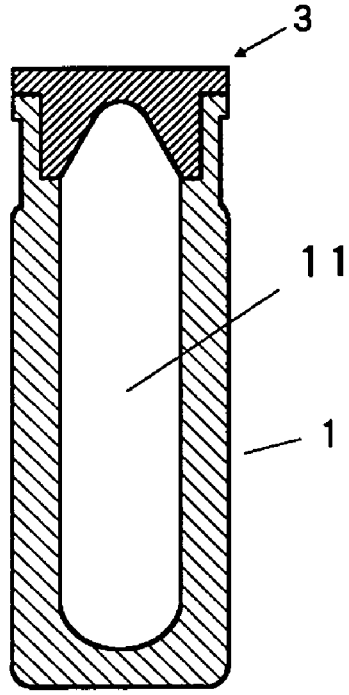

The drug container unit shown in FIG. 4A is an example constructed such that the portion located as the shoulder of the container in the vicinity of the boundary between the drug-solution-containing portion 1 and the mouth portion 2 is eliminated and the bottom wall of the drug-solution-containing portion 1 and the inner wall of the substantially cylindrical leg portion of the rubber closure 3 are both formed into similar hemispherical shapes, respectively. When the inner wall of a container and the inner wall of a rubber closure are wholly formed into rounded shapes as in the above-described example, the downward flow of the drug solution is rendered smoother so that the drug solution can be efficiently collected in a syringe. Described specifically, the construction of a drug container unit as shown in FIG. 4A makes it possible to allow the contained drug solution to smoothly flow along a rounded smooth surface and further to gather at one point on the inner wall of a rubber closure at the time of such use that the container is turned upside down and the drug solution is collected into a syringe. Even if the drug solution is a high-viscosity drug solution, it is, therefore, possible to reduce the amount of the drug solution that remains in the container after its use. In the case of the container exemplified in FIG. 4B, on the other hand, the rubber closure used in combination with the container can also have such a shape that, similarly to the rubber closure illustrated by way of example in FIGS. 1A-1 through 1A-3, the thickness of the leg portion of the rubber closure becomes gradually greater from its lower end wall to the lower wall of its head portion; and the space defined by the inner wall of the substantially cylindrical leg portion takes the form of a circular cone with a rounded apex.

No particular limitation is imposed on the material of the container which constitutes the drug container unit according to the present invention, insofar as it has such a shape as described above. It is, however, necessary to meet requirements such as high chemical resistance, because its application purpose is to contain a drug. The container for use in the present invention can employ any conventionally-known material for the formation of vials. For example, its production is feasible even with glass. It is, however, especially preferred to use a plastic material from the standpoint of readiness in production because the container for use in the present invention is internally provided with a ring-shaped ridge. The plastics to be used can preferably be transparent or semitransparent from the viewpoint of making it possible to confirm, for example, the drug solution contained in the container and the position of a hypodermic needle inserted into the container, and further, can preferably have water repellency and chemical resistance. More specific examples can include, but are not limited to, cyclic olefin polymers and their hydrogenation products, $\alpha$-olefin polymers such as PE and PP, fluorinated resins, and the like. No particular limitation is imposed on the molding process of plastics-made vials although they can be produced by injection molding, blow molding or the like.

As mentioned above, the drug container unit according to the present invention is suited especially where the remaining of a drug solution in the container after its use has a great adverse effect, for example, where the drug solution is expensive or where the volume of the drug solution to be contained is small. The present invention can bring about greater advantageous effects when the capacity of the container for use in the present invention is 10 mL or smaller, although no particular limitation is imposed on the capacity of the container.

Figure 5A:
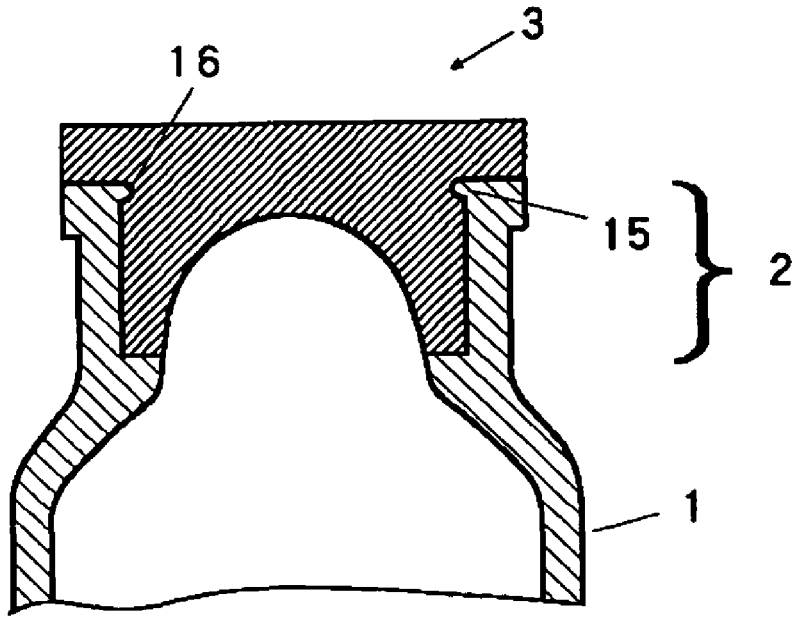
FIG. 5A and FIG. 5B are fragmentary cross-sectional views of preferred embodiments of the container unit for a drug according to the present invention, respectively.
Figure 5B:
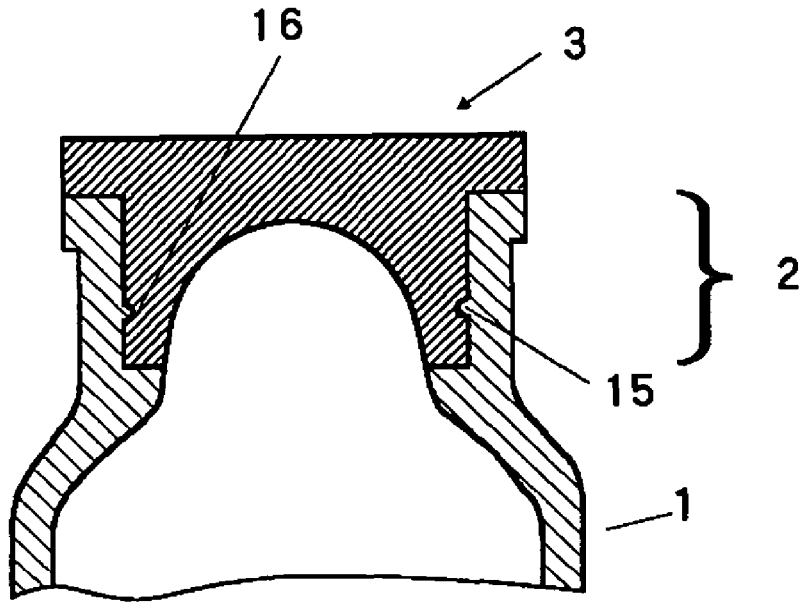

As preferred embodiments of the container which constitutes the drug container unit according to the present invention, a ridge can be formed at a desired position of a mouth portion 2 of the container optionally as indicated by numeral 15 in FIG. 5A and FIG. 5B, respectively. As an alternative, it is also preferred to form a groove (not shown). When a ridge or groove is formed on the inner wall of the container as described above, a rubber closure 3 which is adapted to seal the mouth portion 2 of the container is provided on an outer circumferential wall thereof with a groove or ridge of such a shape that the groove or ridge of the rubber closure 3 remains in engagement with the ridge or groove of the container after the container has been sealed. Specifically, as indicated by numeral 16 in FIG. 5A or FIG. 5B, the rubber closure 3 is provided on its outer circumferential wall with a groove of such a shape that the groove of the rubber closure 3 can be brought into engagement with the ridge 15 of the container.

The above-described construction can further assure the engagement between the mouth portion 2 of the container and the rubber closure 3. Described more specifically, the above-described construction makes it possible to become surely aware of the end point of capping based on a sensation of capping as typified by a "snap" sound which is produced as a result of the engagement of the ridge when the rubber closure is capped to seal the mouth portion 2 of the container. In addition, this ridge-groove engagement can prevent loosening of the rubber closure 3. It is to be noted that the ridge or groove arranged on the inner wall of the mouth portion 2 of the container can be arranged in a continuous form or discontinuous form at a desired location of the mouth portion 2. From the viewpoint of prevention of loosening of the rubber closure 3, however, it is desired to arrange the ridge or groove on the side of an opening of the mouth portion 2, in other words, on the side of a basal end of the leg portion of the rubber closure, said leg portion being to be brought into engagement with the mouth portion 2.

As already explained in the above, it is only required for the rubber closure, which constitutes the drug container unit according to the present invention, that, when the mouth portion 2 has been sealed with the rubber closure 3, the lower end wall 7 of the leg portion 10 of the rubber closure remains in close contact with the flat surface 4 formed in the container without protrusion of the inner circumferential edge 5 of the lower end wall 7 of the rubber closure toward the interior of the cylindrical drug-solution-containing portion 1 beyond the inner circumferential edge 6 of the flat surface 4. No particular limitations are imposed on the shapes, materials and the like of other parts.

Figures 1, 6A:
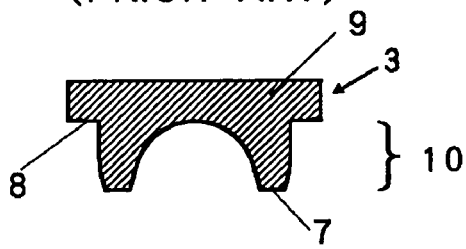
Fig.6A – 1 (PRIOR ART)

The rubber closures shown by way of example in FIGS. 6A-1 and 6A-2 and FIGS. 6B-1 and 6B-2 have been used for many years as rubber closures for vials adapted to contain liquid drugs. These rubber closures are each equipped on a lower wall of a head portion 9 with a leg portion 10, which is substantially cylindrical and has an annular shape at a lower end wall 7 (see the mesh-patterned parts in FIG. 6A-2 and FIG. 6B-2). In the present invention, such conventional rubber closures are all usable provided that the shapes of their leg portions 10 meet the above-described requirement in relation to the flat surfaces 4 formed in the corresponding containers. In the rubber closure shown in FIGS. 6A-1 and 6A-2, the top part of the inner wall of the leg portion 10 as viewed in cross-section has an arc shape as depicted in FIG. 6A-1. In the rubber closure shown in FIGS. 6B-1 and 6B-2, the top part of the inner wall of the leg portion 10 as viewed in cross-section has a straight shape at a section thereof as depicted in FIG. 6A-1. In the present invention, it is preferred to form the inner wall of the leg portion 10 of the rubber closure 3 in such a cross-sectional shape that, with the drug container unit being held upside down, the drug solution is allowed to gather at one point to facilitate the collection of the drug solution from the vial by a syringe as illustrated in FIG. 6A-1 or FIG. 2A. From such a viewpoint, the rubber closure shown in FIG. 6A-1 is more preferred than that illustrated in FIG. 6B-1, with the use of a rubber closure of the shape depicted in FIG. 2A being more preferred.

Figures 2, 6A:
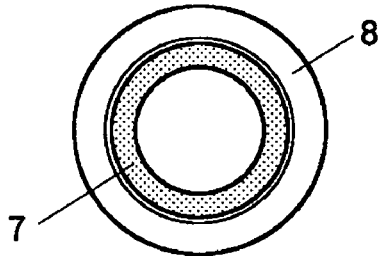
Fig.6A – 2 (PRIOR ART)
Figures 1, 6B:
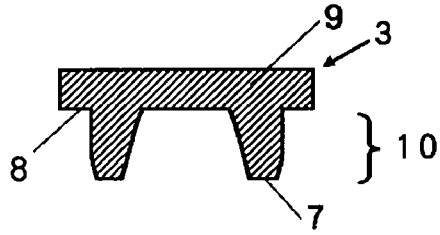
Fig.6B – 1 (PRIOR ART)
Figures 2, 6B:
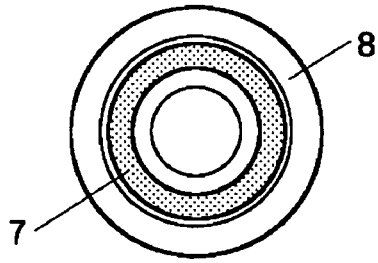
Fig.6B – 2 (PRIOR ART)

In the present invention, the rubber closure is not limited to those having leg portions 10 the lower end walls 7 of which are in annular shapes as described above. It is also possible to use rubber closures, each of which is of the form that its leg portion is provided with one or more cut-off portions at a like number of parts thereof as illustrated by way of the example in FIGS. 7A-1 and 7A-2 or FIGS. 7B-1 and 7B-2. These rubber closures are each provided with one or more cut-off portions at a like number of parts, that is, a like number of locations of the leg portion, and as illustrated in FIG. 7A-2 or FIG. 7B-2 (see the mesh-patterned part), a lower end wall 7 of the leg portion 10 is in the form that an annulus is provided with one or more cut-off portions at a like number of locations. Rubber closures each of which is provided at its leg portion with such cut-off portion or portions have been used for many years to seal vials with powder preparations contained therein, for example, with antibiotics, protein preparations, peptide preparations, blood preparations or the like contained as lyophilized preparations or the like such that upon emergency administration, they are dissolved and used as drug solutions. In the present invention, any rubber closures, each of which is provided at its leg portion with one or more of such cut-off portions, can be suitably used provided that the shapes of their leg portions 10 meet the above-described requirement in relation to the flat surfaces 4 formed in their corresponding containers.

The rubber closure depicted in FIGS. 7A-1 and 7A-2 is of the construction that the substantially cylindrical leg portion 10 has a cut-off portion at a part thereof, while the rubber closure illustrated in FIGS. 7B-1 and 7B-2 is of the construction that the substantially cylindrical leg portion 10 is divided into two parts by cut-off portions. The rubber closures depicted in FIGS. 7A-1 and 7A-2 and FIGS. 7B-1 and 7B-2 are each in such a substantially cylindrical form that the leg portion 10 is free of any cut-off portion at a part thereof of about one third of its entire length on the way down from a lower wall 8 of a head portion 9; the leg portion is provided with the cut-off portion or portions at the part lower than the above-mentioned about one-third part. The use of a rubber closure having such cut-off portion or portions is convenient, because upon production of a lyophilized preparation, for example, one or more openings can be formed at upper locations within the cut-off portion or portions by lightly capping a vial with the rubber closure.

It is only necessary for a medical rubber closure of such a form as described above, which is useful in the present invention, to have the above-described requirement, and no particular limitations are imposed on other details such as the size of the rubber closure, the length of the leg portion, the structure of the leg portion, the shape of the inner wall of the leg portion, and the material. Because the container according to the present invention is used for a drug, it is, however, preferred to use a rubber closure with a film of a polymer inert to drug solutions, such as a fluorinated resin or polyethylene, for example, laminated on at least a surface thereof which comes into contact with a drug solution in the container.

In each rubber closure for use in the present invention, it is preferred to shape the lower end wall 7 of its leg portion 10 in a planar form so that the area of contact with the flat surface 4 arranged in the container is made larger to improve the sealing performance when the container is capped. The lower wall 8 of the head portion 9 of the rubber closure, said lower wall 8 being to be brought into contact with the flange wall of the mouth portion 2 of the container, can be formed into a concave wall as shown in FIG. 2A, although it may be a planar wall. When formed in such a concave wall, a greater area of contact can be established under pressure upon capping. It is also preferred to form the inner wall of the leg portion 10 of the rubber closure, said inner wall being brought into contact with a drug solution, in such a shape that the collection of the drug solution contained in the vial by a syringe is facilitated as mentioned above. To further reduce the radius of curvature of the lower wall 8 of the head portion 9 for this purpose, it is desired to form the leg portion 10 of the rubber closure such that as illustrated in FIG. 2A, the wall thickness of the leg portion 10 becomes gradually greater toward the lower wall 8 of the head portion 9. A vertical angle θ, which appears in a cross-section of the leg portion 10, is determined by the repellency of the inner wall of the leg portion 10 of the rubber closure to be brought into contact with a drug solution, the viscosity of the drug solution, the capacity of an associated vial, etc., and no particular limitation is imposed thereon. Nonetheless, it is preferred to make the vertical angle θ, which appears in a cross-section of the leg portion, smaller as the capacity of the vial becomes smaller. The inner wall of the substantially cylindrical leg portion 10 may desirably be rounded at an area on the side of the lower wall 8 of the head portion 9 (namely, the apex portion) to such an extent that a drug solution can still be withdrawn even if a hypodermic needle is pierced somewhat obliquely. It is also a preferred form of the rubber closure for use in the present invention that a conical recess 12 or the like is formed as a guide for a hypodermic needle in the neighborhood of the center on the upper wall of the head portion 9.

The present invention will hereinafter be described specifically based on examples and comparative examples.

EXAMPLE 1

A small-capacity vial and rubber closure of the shapes shown in FIGS. 1A-1 through 1A-3 were fabricated as will be described below, and were provided as a drug container unit of this example. Using a cyclic olefin resin ("DAIKYO RESIN CZ", trade name; product of DAIKYO SEIKO, LTD.) as a material for the container, a vial of the shape shown in FIGS. 1A-1 through 1A-3 was produced by injection molding. The capacity of the thus-obtained vial was about 0.6 mL, and the inner diameter of a portion in which a drug solution would be contained was 5 mm. In that vial, the inner diameter of a mouth portion 2 was 7 mm, and the length L2 (see FIG. 2C) of a portion of a mouth portion 2, in said portion a leg portion 10 of the rubber closure was to be inserted, was 6 mm.

On the other hand, the rubber closure to be combined with the vial obtained as described above was fabricated as will be described hereinafter. Using butyl rubber, a rubber closure was produced by compression molding with a portion of the rubber closure, said portion being located below a head portion 9 and being possibly brought into contact with the drug solution, being laminated with a fluorinated resin. The shape of the rubber closure was as depicted in FIGS. 2A and 2B. Described specifically, the diameter of the outer circumference of the head portion 9 was 12.6 mm, the length L of the leg portion 10 was 6.5 mm, and the average diameter of the outer circumference of the leg portion 10 was 7.2 mm. A flat surface 4 located at the boundary between the mouth 2 and the drug-solution-containing portion 1 was in an annular form, and its width was 1.0 mm. Further, the inner wall of the leg portion 10 was formed such that the vertical angle θ which appeared in a cross-section of the leg portion was somewhat rounded as illustrated in FIG. 2A. Furthermore, the surface of the lower wall 8 of the head portion 9, which was to be brought into contact with the flange wall of the vial, was in a concave form as shown in FIG. 2A.

EXAMPLE 2

A drug container unit of this example was provided in a similar manner as in Example 1 except that the capacity of the vial was changed. Described specifically, in the container of the drug container unit of this embodiment, the flat surface 4 arranged at the boundary between the drug-solution-containing portion 1 and the drug-solution-filling neck portion 2 is in a similar form as that illustrated in FIGS. 3A-1 to 3A-3, and the rubber closure for sealing the container was the same as that employed in Example 1. The vial employed in this example had an inner diameter of 10 mm in the drug-solution-containing portion thereof, and had a capacity of about 3.2 mL.

EXAMPLE 3

In a drug container unit of this example, the vial had a similar capacity as in Example 1, and had a similar shape as illustrated in FIG. 4A. The rubber closure for sealing the container was the same as that used in Example 1.

COMPARATIVE EXAMPLE 1

Using the same material as in Example 1, a vial of 7 mm in both of the inner diameter of its mouth portion and the inner diameter of its drug-solution-containing portion was produced as a vial for use in this comparative example by injection molding in a similar manner as in Example 1. The capacity of the drug-solution-containing portion was about 0.6 mL. Described specifically, the vial of this comparative example had the same inner diameter at the mouth portion 2 and at the drug-solution-containing portion 1, and different from Examples 1-3, was not provided with any flat surface at the boundary between the mouth portion and drug-solution-containing portion in the vial. The rubber closure employed in this comparative example was the same as that employed in Example 1. A combination of those vial and rubber closure was provided as a drug container unit of Comparative Example 1.

EXAMPLES 4-6

Provided as a drug container unit of Example 4 was a combination of the vial employed in Example 1 and a rubber closure adapted to seal the mouth portion of the vial and having a similar shape as illustrated in FIGS. 3A-1 through 3A-3. A similar drug container unit as in Example 4 except that the rubber closure was shaped as in FIG. 3B was provided as a drug container unit of Example 5. Further, a similar drug container unit as in Example 4 except that the rubber closure was shaped as in FIG. 3C was provided as a drug container unit of Example 6.

COMPARATIVE EXAMPLE 2-4

Figure 8A:
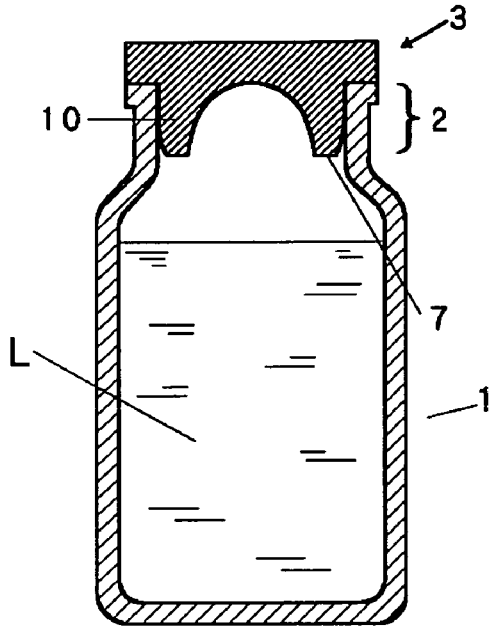
Fig.8A (PRIOR ART)
FIGS. 8A and 8B are schematic cross-sectional views showing the structure of a conventional container unit for a drug.
Figure 8B:
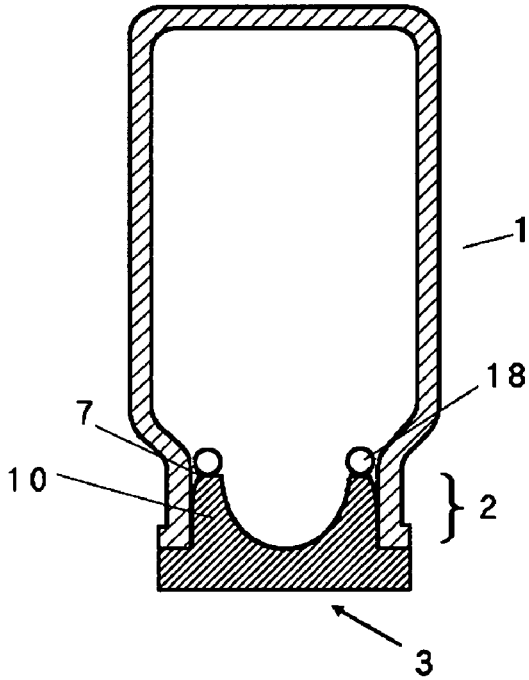
Fig.8B (PRIOR ART)

Provided as drug container units of Comparative Examples 2-4 were similar drug container units as in Example 4-6 except that the vials had the same shape as in FIG. 8A, that is, had no flat surface therein.

Assessment

The drug container units of Examples 1-6 and Comparative Examples 1-4 were provided as much as 10 units per example or comparative example. By the below-described method, an assessment was performed based on the amount of a drug solution remaining in each container after the drug solution was collected by a syringe. Firstly, each vial was capped with its corresponding rubber closure, and the rubber closure was wrapped up with an aluminum-made cap to seal the vial. With respect to each ten units so capped, their weights $M_0$ were separately measured. After an air venting needle was pierced through the rubber closure of each unit, deionized water was filled in a predetermined volume shown in Table 1 by a syringe, and then, the capped vial with the deionized water filled therein was allowed to stand for 24 hours. With the rubber closures held down, the deionized water was then collected by a syringe from each of the units by the same assessor such that the collection was effected under the same conditions. After the collection, the weights $M_1$ of the ten emptied drug container units were individually measured. The amount of the deionized water remaining in each unit of the corresponding example or comparative example was calculated in accordance with the below-described formula. An average of the calculation results is shown in Table 1.

$$\text{Amount of residual deionized water}=M_1-M_0$$

As shown in Table 1, it has been confirmed that, when deionized water is collected by a syringe, the residual amount is far smaller with the drug container units of the examples of the present invention than with the units of the comparative examples. It has also been confirmed that, even when the shape of the leg portion of the rubber closure is modified, the residual amount of deionized water upon collection of deionized water by a syringe is far smaller than the conventional drug container units of the comparative examples provided that a container of a shape—which meets the requirement that the lower end surface 7 of the leg portion 10 of the rubber closure and the flat surface 4 of the container are brought into close contact with each other without any protrusion of the inner circumferential edge 5 of the lower end wall 7 toward the interior of the container beyond the inner circumferential edge 6 of the flat surface 4 when the mouth portion 2 of the container is sealed with the rubber closure 3—is used.

TABLE 1

| | Filled amount of deionized water (mL) | $M_0$ (g: average) | $M_1$ (g: average) | Residual amount of deionized water (g: average) |
|---|---|---|---|---|
| Example 1 | 0.5 | 4.282 | 4.302 | 0.020 |
| Example 2 | 3.0 | 5.441 | 5.465 | 0.024 |
| Example 3 | 0.5 | 4.173 | 4.192 | 0.019 |
| Comp. Ex. 1 | 0.5 | 4.278 | 4.321 | 0.043 |
| Example 4 | 0.5 | 4.208 | 4.229 | 0.021 |
| Example 5 | 0.5 | 4.222 | 4.243 | 0.021 |
| Example 6 | 0.5 | 4.183 | 4.207 | 0.024 |
| Comp. Ex. 2 | 0.5 | 4.205 | 4.251 | 0.046 |

TABLE 1-continued

| | Filled amount of deionized water (mL) | $M_0$ (g: average) | $M_1$ (g: average) | Residual amount of deionized water (g: average) |
|---|---|---|---|---|
| Comp. Ex. 3 | 0.5 | 4.221 | 4.270 | 0.049 |
| Comp. Ex. 4 | 0.5 | 4.180 | 4.225 | 0.045 |

This application claims the priority of Japanese Patent Application 2004-266537 filed Sep. 14, 2004, which is incorporated herein by reference.

What is claimed is:

1. A container unit for a drug, said container unit being composed in combination of a container, which is formed of a cylindrical drug-solution-containing portion and a drug-solution-filling neck portion, and a rubber closure for sealing said drug-solution- filling neck portion, wherein:

said rubber closure comprises a disk-shaped head portion and a substantially cylindrical leg portion arranged on a lower wall of said head portion;

said container is provided with a flat surface formed on a side of an inner wall thereof at a boundary between said drug-solution-containing portion and said drug-solution-filling neck portion such that a lower end wall of said leg portion of said rubber closure can be brought into close contact with said flat surface, and at least a side wall of said drug-solution-containing portion forms a flush, rounded surface on a side, where a drug solution is to be contained and also defines a cylindrical space of uniform diameter below said flat surface; and when said drug-solution-filling neck portion has been sealed with said rubber closure, said lower end wall of said leg portion and said flat surface of said container are maintained in close contact with each other without any protrusion of an inner circumferential edge of said lower end wall into an interior of said container beyond an inner circumferential edge of said flat surface, and wherein the substantially cylindrical leg portion of the rubber closure has a length $L_1$, $L_1$ measured in a direction perpendicular to the flat surface, wherein a mouth portion of the container has a length $L_2$, $L_2$ measured from a top surface of an opening of the container to the flat surface and in a direction perpendicular to the flat surface, and wherein $L_1>L_2$.

2. A container unit according to claim 1, wherein all walls, which forms a sealed space defined by an inner wall of said rubber closure and an inner wall of said drug- solution-containing portion, form cornerless, rounded surfaces, respectively.

3. A container unit according to claim 1, wherein in a sealed space formed by an inner wall of said rubber closure and an inner wall of said drug-solution-containing portion to contain a drug solution therein, a space defined in a bottom part of said drug-solution-containing portion is in the form of a circular cone, and a space defined by an inner wall of said substantially cylindrical leg portion of said rubber closure is in a form of a circular cone with a rounded apex portion.

4. A container unit according to claim 1, wherein said lower end wall of said leg portion of said rubber closure is in an annular form.

5. A container unit according to claim 1, wherein said leg portion of said rubber closure is provided with a cut-off portion at at least one location of a substantially cylindrical portion thereof, and said lower end wall of said leg portion has an annular shape with a cut-off portion formed at at least one location thereof corresponding to said at least one location of said substantially cylindrical portion.

6. A drug container capable of defining a sealed space therein to contain a drug solution upon closure of a mouth portion thereof with a rubber closure having a disc-shaped head portion and a substantially cylindrical leg portion arranged on a lower wall of said head portion, wherein:

said container comprises a cylindrical, drug-solution-containing portion, a drug-solution-filling neck portion, and a flat surface formed on a side of an inner wall of said container at a boundary between said drug-solution-containing portion and said drug-solution- filling neck portion such that a lower end wall of said leg portion of said rubber closure can be brought into close contact with said flat surface, and at least a side wall of said drug-solution-containing portion forms a flush, rounded surface on a side, where a drug solution is to be contained, and also defines a cylindrical space of uniform diameter below said flat surface, wherein the substantially cylindrical leg portion of the rubber closure has a length $L_1$, $L_1$ measured in a direction perpendicular to the flat surface, wherein a mouth portion of the container has a length $L_2$, $L_2$ measured from a top surface of an opening of the container to the flat surface and in a direction perpendicular to the flat surface, and wherein $L_1>L_2$.

7. A drug container according to claim 6, wherein said flat surface formed on the side of said inner wall of said container is arranged at a position and is provided with a shape such that, when said drug-solution-filling neck portion has been sealed with said rubber closure, said lower end wall of said leg portion of said rubber closure and said flat surface of said container are maintained in close contact with each other without any protrusion of an inner circumferential edge of said lower end wall into an interior of said container beyond an inner circumferential edge of said flat surface.

8. The container unit according to claim 1, further comprising a ridge formed on an outer circumferential wall of the rubber closure.

9. The container unit according to claim 1, further comprising a groove formed on an outer circumferential wall of the rubber closure.

10. The container unit according to claim 1, wherein the substantially cylindrical leg portion is divided into two sections by cut-off portions.

11. The container unit according to claim 1, wherein the lower wall of the head portion forms a concave wall.

12. The container unit according to claim 1, wherein the substantially cylindrical leg portion has one cut-off portion.

* * * * *